US005584228A

United States Patent [19]

Jepsen

[11] Patent Number: 5,584,228

[45] Date of Patent: Dec. 17, 1996

[54] SLANTING PLATE ARRANGEMENT IN A HYDRAULIC AXIAL PISTON MACHINE

[75] Inventor: Hardy P. Jepsen, Nordborg, Denmark

[73] Assignee: Danfoss A/S, Nordborg, Denmark

[21] Appl. No.: 464,690

[22] PCT Filed: Jan. 12, 1994

[86] PCT No.: PCT/DK94/00020

§ 371 Date: Jun. 6, 1995

§ 102(e) Date: Jun. 6, 1995

[87] PCT Pub. No.: WO94/16223

PCT Pub. Date: Jul. 21, 1994

[30] Foreign Application Priority Data

Jan. 18, 1993 [DE] Germany ..... 43 01 119.5

[51] Int. Cl.[6] ..... F01B 3/00

[52] U.S. Cl. ..... 92/71; 74/60

[58] Field of Search ..... 91/499; 92/71; 74/60

[56] References Cited

U.S. PATENT DOCUMENTS 3,139,037 6/1964 Budzich ..... 91/505

3,221,564 12/1965 Raymond ..... 74/60

3,450,058 6/1969 Stein ..... 92/71

OTHER PUBLICATIONS

International Plastics Handbook, 2nd ed. New York, Oxford University Press, 1989, pp. 234–235, TP1130.s2413 1987b.

*Primary Examiner*—F. Daniel Lopez

*Attorney, Agent, or Firm*—Lee, Mann, Smith, McWilliams, Sweeney & Ohlson

[57] ABSTRACT

A slanting plate arrangement in a hydraulic axial piston machine is disclosed, having a slanting plate and a pressure plate, between which at least one slider shoe of a piston axially movable in a cylinder body is held, the pressure plate being rotatably connected to the slanting plate by means of an axle element limiting axial movement of the pressure plate with respect to the slanting plate in at least one direction. It is desirable to be able to use such a slanting plate arrangement even when a hydraulic fluid that has no or only slight lubricating properties is used. For that purpose, in the region of contact between the axle element and the pressure plate and/or axle element and slanting plate, a material combination of a metal and a high-strength thermoplastic plastics material is provided.

9 Claims, 1 Drawing Sheet

SLANTING PLATE ARRANGEMENT IN A HYDRAULIC AXIAL PISTON MACHINE

Figure 1:
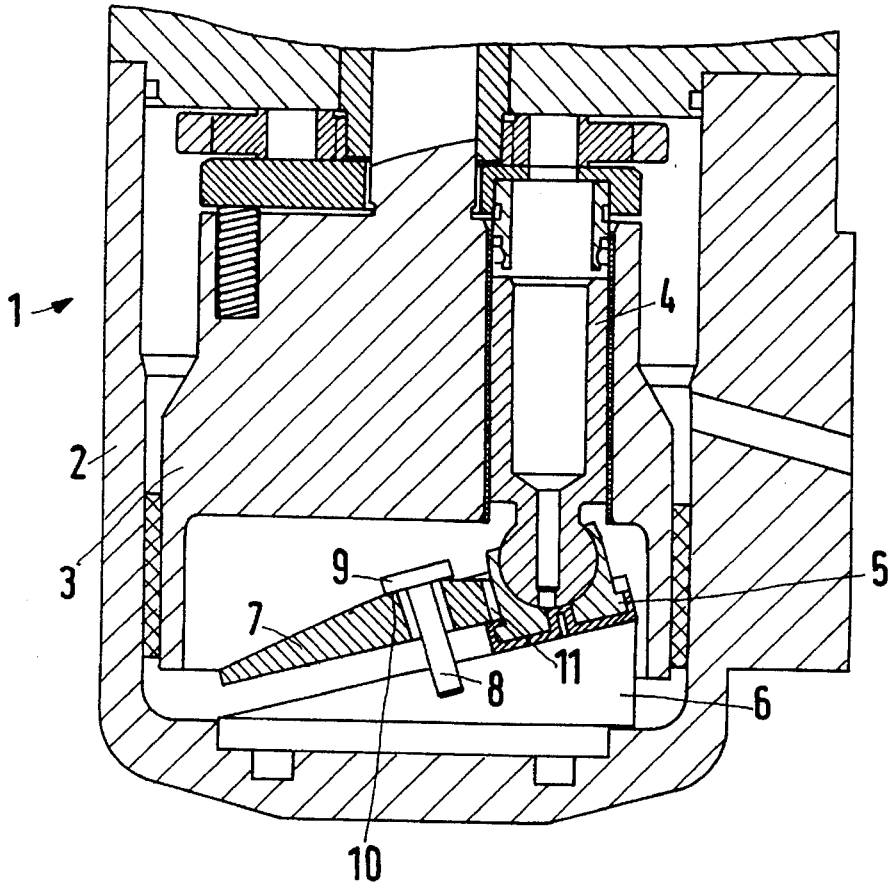

The invention relates to a slanting plate arrangement in a hydraulic axial piston machine having a slanting plate and a pressure plate, between which at least one slider shoe of a piston axially movable in a cylinder body is held, the pressure plate being rotatably connected to the slanting plate by means of an axle element limiting axial movement of the pressure plate with respect to the slanting plate in at least one direction.

In a known slanting plate arrangement of that kind (DE 32 12 402 A1) the axle element is formed by a screw bolt which is guided from the side remote from the pressure plate through the slanting plate and projects through the pressure plate. A nut is screwed onto the end projecting from the pressure plate. The screw bolt is rotatably mounted in the slanting plate.

When the cylinder body rotates, the slider shoes of the pistons, which are arranged in bores in the pressure plate, carry the pressure plate with them, that is to say, the pressure plate is rotated with respect to the slanting plate. During this movement, friction occurs between the slanting plate and the screw bolt. This friction causes wear and tear on the machine. If no preventative measures are taken, it can also lead to the parts that move relative to one another seizing up. To avoid this, the surfaces that rub against one another are lubricated. This lubrication is normally carried out by the hydraulic fluid.

A hydraulic fluid that has a lubricating action is therefore an essential requirement here. This lubricating action is without exception a property of the hydraulic oils until now used as hydraulic fluids. Such oils, in particular those on a synthetic basis, are in some cases toxic, however. Their range of application is therefore limited. From the point of view of their effect on the environment they are being used with increasing reluctance.

The problem on which the invention is based is to be able to use a slanting plate arrangement of the kind mentioned in the introduction even when hydraulic fluids having little lubricating action or even no lubricating action are to be used, for example, water.

This problem is solved in a slanting plate arrangement of the kind mentioned in the introduction in that in the region of contact between the axle element and the pressure plate and/or axle element and slanting plate, a material combination of a metal and a high-strength thermoplastic plastics material is provided.

The use of such a combination of material enables an extremely low-friction sliding contact of the parts moved relative to one another. Lubrication is largely superfluous. In most cases, lubrication is not required at all. For the rest, a film of fluid, such as that provided by water, for example, will be sufficient for lubrication. The function of friction prevention or reduction, which has previously had to be taken on by an operating substance to be supplied from the outside, namely, the hydraulic fluid, is now assumed by parts of the machine. This considerably facilitates control of the operational behaviour. Provision no longer has to be made for the hydraulic fluid to reach the surfaces to be lubricated.

The plastics material is preferably selected from the group of polyaryl ether ketones, especially polyether ether ketones, polyamides or polyamide imides. Such plastics materials are particularly low-friction in combination with metals, so that when they are used, further lubrication by means of oils, greases or similar substances can be omitted without problems.

The plastics material is preferably reinforced by glass, graphite, polytetrafluoroethylene or carbon in fibre form. This measure enables the piston to be stressed by higher forces. Wear is reduced. In particular, the tensile and compressive strength of the plastics material is increased as a result.

In a preferred construction, the axle element is formed by a screw screwed into the slanting plate. It is a simple matter to screw a screw into the slanting plate.

In a preferred construction, a bearing element of plastics material is arranged between the axle element and the pressure plate. The pressure plate and the axle element can therefore remain substantially unaltered and so retain their mechanical stability. All that is required is to make space for the bearing element. The bearing element forms a layer between the two parts movable relative to one another, which replaces the "lubricating film" of the hydraulic fluids used previously.

The bearing element is preferably in the form of an injection-moulded part, which is integrally injection-moulded with the axle element or the pressure plate. The individual machine parts can therefore be handled as before. During assembly or during repair, it is not necessary to handle a separate part, namely, the bearing element. Integral injection-moulding ensures that the bearing element takes up exactly the desired position within the machine so that a high-precision construction thereof can be guaranteed.

The bearing element is preferably in the form of an annular washer which is arranged between the pressure plate and a circumferential projection of the axle element. The annular washer absorbs only forces that act in an axial direction, but these are the principal forces so that a reduction in friction here is in most cases sufficient.

The annular washer preferably has an inner diameter that is smaller than the inner diameter of a bore in the pressure plate through which the axle element passes, and the annular washer is guided radially in the pressure plate. In this manner the axle element is spaced all round from the pressure plate in a radial direction. This guaranteed spacing prevents friction between these two parts.

In this connection it is an advantage that there is a radial clearance between the annular washer and the pressure plate, which is smaller than half of the difference between the two inner diameters. The annular washer can therefore move quite freely with respect to the pressure plate. This facilitates manufacture. On the other hand, the dimensioning criteria ensure that despite the freedom of movement, the axle element and the pressure plate cannot touch.

The annular washer preferably has an outer diameter that is larger than the diameter of the projection, the annular washer being arranged in a recess in the pressure plate. The arrangement of the annular washer in a recess has the advantage that the annular washer is guided in a radial direction. In order to overcome the obstacle that the recess must be at most the depth of the annular washer, but contact between the projection and the pressure plate must nevertheless reliably be avoided, the outer diameter of the annular washer is selected to be larger than the diameter of the projection. Even with a radial movement of the axle element and pressure plate towards one another, direct contact between the two parts is impossible.

The annular washer preferably has a sleeve-shaped extension of reduced outer diameter, which surrounds the axle element for a part of its axial length and extends into the pressure plate. By that means, the annular gap formed, for example, between the pressure plate and axle element can be entirely or partially filled. Additional guidance of the pressure plate on the axle element is provided without any additional friction occurring. More accurately, the plastics material keeps the friction extremely low in this area as well.

The annular washer preferably has a thickness that is selected in dependence upon the thickness of the pressure plate and the height of the slider shoe. In particular when using a screw as the axle element, in which the projection is formed by the head of the screw, the screw has to be screwed into the slanting plate to a depth that corresponds to the thickness of the plate and the height of the slider shoe. The depth to which the screw is screwed in can here be limited by a depth stop fixedly provided in the slanting plate. The screw must, on the one hand, sit firmly enough for the pressure plate to run virtually without play, and does not therefore allow axial movements, but on the other hand it must not sit too firmly, that is, must not exert too great a pressure on the pressure plate so that the slider shoes are not clamped against the slanting plate. Both these requirements can be fulfilled by manufacturing all parts with great precision. This is complicated and expensive, however. A simpler way is to provide annular washers of different thicknesses and in each individual case to select the annular washer of the correct thickness so that the pressure plate is pressed with the correct tension against the slanting plate. This measure means that greater tolerances can be allowed.

In a further preferred embodiment, the axle element can be made of plastics material and the pressure plate can be made of metal. In another alternative, the pressure plate can be made of plastics material and the axle element can be made of metal. The pressure plate can also be in the form of a metal part completely encased in the plastics material. In all cases, in the contact region there is then a material combination of metal and plastics material which, as already mentioned, provides very favourable coefficients of friction. Hydraulic fluid cannot destroy this combination, for example by detaching plastics material parts.

The part consisting of plastics material is preferably in the form of an injection-moulded part. Injection-moulded parts can be manufactured inexpensively with great accuracy.

Figure 2:
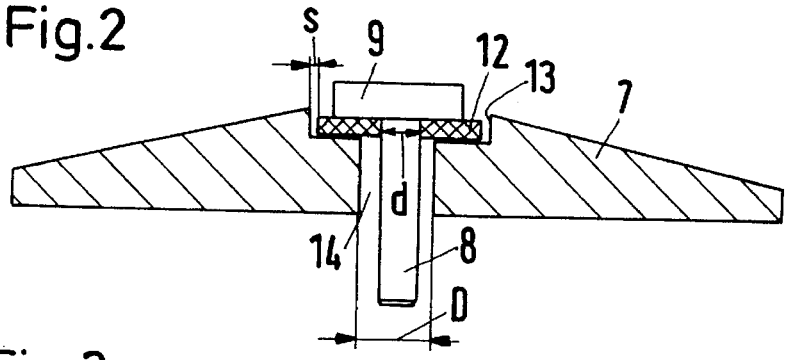
Figure 3:
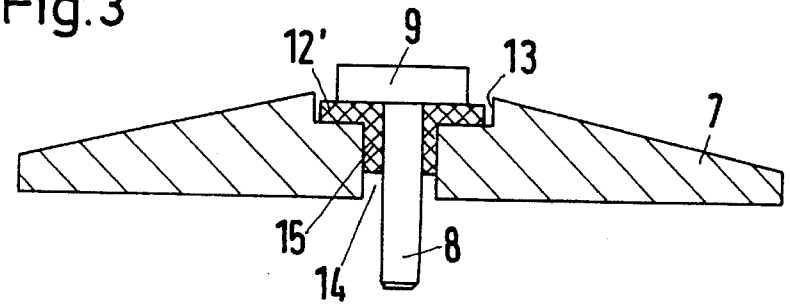

The invention is described hereinafter with reference to preferred embodiments and in conjunction with the drawing, in which FIG. 1 shows a diagrammatic cross-section through a hydraulic axial piston machine, FIG. 2 shows a first embodiment of a bearing element and FIG. 3 shows a second embodiment of a bearing element.

A hydraulic axial piston machine 1, which can be used as a pump or as a motor, has a cylinder drum 3 rotatably mounted in a housing 2. Work pistons 4 are mounted in the cylinder drum 3 so as to move in an axial direction. Each work piston 4 is guided by a slider shoe 5 on a slanting plate 6. Each slider shoe 5 is held in engagement with the slanting plate 6 by a pressure plate 7. Although this is not shown in the drawing, the angle of inclination of the slanting plate 6 can be varied.

The pressure plate 7 is fixed to the slanting plate 6 by means of a screw bolt 8 serving as axle element. The screw bolt 8 has a head 9 which forms a circumferential projection 10.

If the cylinder drum 3 now rotates in the housing 2, the slider shoes 5, which are guided in bores 11 of the pressure plate 7, carry the pressure plate 7 with them, that is to say, they cause it to rotate synchronously with the cylinder drum 3. During this rotation, friction occurs between the screw bolt 8, that is, its head 9, and the pressure plate 7. In order to keep this friction as low as possible, in the contact region between the pressure plate 7 and the screw bolt 8 there is provided a material combination comprising a metal, for example, steel, and a high-strength thermoplastic plastics material, which can be selected, for example, from the group of polyarylether ketones, especially polyether ether ketones, polyamides or polyamide imides. The plastics material can be fibre-reinforced, wherein the fibres can be formed from glass, graphite, polytetrafluoroethylene or carbon.

The material combination can be produced by making one of the two parts pressure plate 7 or screw bolt 8 from the said plastics material. The pressure plate 7 can also be formed by a metal part with plastics material moulded completely around it. Hydraulic fluid cannot penetrate between the plastics layer and the metal core, so that damage caused by penetrating hydraulic fluid, for example, detachment of the layer, can be avoided. The combination of materials can also be achieved, as illustrated in FIG. 2, by providing a bearing element in the form of an annular washer 12 between the head 9 of the screw bolt 8 and the pressure plate 7. This annular washer 12 is integrally injection-moulded with the screw bolt 8, which can be achieved using an injection-moulding process. The annular washer 12 is arranged in a recess 13 in the pressure plate 7. It has an inner diameter d which is smaller than the inner diameter D of a bore 14 receiving the screw bolt 8 in the pressure plate 7. The annular washer 12 is guided in the recess 13 with a radial clearance s which is less than half the difference between the two inner diameters d, D, in other words, less than the difference between the two radii. The annular washer 12 has an outer diameter that is larger than the outer diameter of the head 9. More accurately, the difference between the outer and inner diameters of the annular washer 12 is greater than the difference between the outer diameters of the head 9 and the bolt 8. This ensures that in the regions in which there is no plastics material between the pressure plate 7 and the screw bolt 8, there can nevertheless be no friction because the screw bolt 8 here is always a guaranteed minimum distance from the pressure plate 7.

FIG. 3 shows a modification of the bearing element, in which the annular washer 12' is provided with a sleeve-like extension 15 which surrounds the screw bolt 8 for a part of its axial length and extends into the bore 14. This sleeve-like extension 15 allows improved guidance of the screw bolt 8 and the pressure plate 7 in relation to one another, but without the friction between the two parts being appreciably increased.

The screw bolt 8 is screwed into the slanting plate 6 to a predetermined depth. This depth is such that the head 9, taking into account the thickness of the annular washers 12 and 12' respectively, the remaining thickness of the pressure plate 6 and the height of the slider shoe 5, presses the pressure plate 7 towards the slanting plate 6 in such a manner that the slider shoes 5 are always held with the necessary force against the slanting plate 6. The depth to which the screw bolt is screwed in must always be calculated so that on the one hand the pressure plate 7 is mounted free from play, that is, is not able to move away from the slanting plate 6 in an axial direction, but on the other hand the pressure acting on the pressure plate 7 is not too great. This would require very accurate adherence to predetermined tolerances during manufacture. To reduce this requirement, that is, to allow greater tolerances, when the machine is being put together a desired thickness of the annular washer 12 is determined, for example, in that the slanting plate arrangement is assembled without the annular washer, and the gap remaining between the head 9 and the pressure plate 7 is measured. An annular washer 12 of matching thickness is then selected and inserted. This measures enables the slanting plate arrangement to be assembled relatively easily with the required accuracy.

I claim:

1. A slanting plate arrangement in a hydraulic axial piston machine having a slanting plate and a pressure plate, between which at least one slider shoe of a piston axially movable in a cylinder body is held, the pressure plate being rotatably connected to the slanting plate by means of an axle element limiting axial movement of the pressure plate with respect to the slanting plate in at least one direction, the axle element comprising a screw having a surrounding projection, the screw being screwed through the pressure plate into the slanting plate, and including a beating element made of a high-strength thermoplastic material located between the projection and the pressure plate to maintain a radial minimum distance between the screw and the pressure plate and to absorb axial forces.

2. An arrangement according to claim 1, in which the thermoplastic material is selected from the group of polyether ether ketones, polyamides and polyamide imides.

3. An arrangement according to claim 1, in which the thermoplastic material is reinforced by glass, graphite, polytetrafluoroethylene or carbon in fibre form.

4. An arrangement according to claim 1, in which the bearing element is in the form of an annular washer which is arranged between the pressure plate and a circumferential projection of the axle element.

5. An arrangement according to claim 4, in which the annular washer has an inner diameter that is smaller than an inner diameter of a bore in the pressure plate through which the axle element passes, and including means guiding the annular washer radially in the pressure plate.

6. An arrangement according to claim 5, including a radial clearance between the annular washer and the pressure plate, which is smaller than half of the difference between said bore inner diameter and said washer inner diameter.

7. An arrangement according to claim 4, in which the annular washer has an outer diameter that is larger than a diameter of the projection, the annular washer being located in a recess in the pressure plate.

8. An arrangement according to claim 4, in which the annular washer has a sleeve-shaped extension of reduced outer diameter, said extension surrounding the axle element for a part of an axial length of said axle element and extending into the pressure plate.

9. An arrangement according to one of claim 4, in which the annular washer has a thickness that is selected in dependence upon thickness of the pressure plate and height of the slider shoe.

* * * * *